US009255540B2

(12) United States Patent
Jung et al.

(10) Patent No.: US 9,255,540 B2
(45) Date of Patent: Feb. 9, 2016

(54) METHOD FOR THE OPERATION OF AN INTERNAL COMBUSTION ENGINE, AND INTERNAL COMBUSTION ENGINE

(75) Inventors: Uwe Jung, Wörth a.d. Donau (DE); Janos Kerekgyarto, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 179 days.

(21) Appl. No.: 14/113,178

(22) PCT Filed: Mar. 19, 2012

(86) PCT No.: PCT/EP2012/054765

§ 371 (c)(1), (2), (4) Date: Oct. 21, 2013

(87) PCT Pub. No.: WO2012/143189

PCT Pub. Date: Oct. 26, 2012

(65) Prior Publication Data

US 2014/0039779 A1 Feb. 6, 2014

(30) Foreign Application Priority Data

Apr. 19, 2011 (DE) ..... 10 2011 007 642

(51) Int. Cl.

*F02D 41/00* (2006.01)
*F02D 41/30* (2006.01)
*F02D 41/24* (2006.01)

(52) U.S. Cl.

CPC ..... *F02D 41/30* (2013.01); *F02D 41/2432* (2013.01); *F02D 41/2467* (2013.01)

(58) Field of Classification Search

CPC ..... F02D 41/40; F02D 41/008; F02D 41/402; F02D 41/405; F02D 41/2467; F02D 2041/1423; F02D 41/2432

USPC ..... 701/101, 102, 103, 104, 105

See application file for complete search history.

(56) References Cited

U.S. PATENT DOCUMENTS 7,139,657 B2 11/2006 Bouchain et al. ..... 701/104
7,353,798 B2 4/2008 Tokuda et al. ..... 123/295

(Continued)

FOREIGN PATENT DOCUMENTS

CN 1928338 A 3/2007
CN 1981131 A 6/2007

(Continued)

OTHER PUBLICATIONS

International Search Report and Written Opinion, Application No. PCT/EP2012/054765, 13 pages, Oct. 18, 2012.

(Continued)

*Primary Examiner* — Hai Huynh
*Assistant Examiner* — Raza Najmuddin
(74) *Attorney, Agent, or Firm* — Slayden Grubert Beard PLLC

(57) ABSTRACT

A method for operating an internal combustion engine and an internal combustion engine are described. In order to recognize and correct the drift in the amount of fuel injected over the service life of the injectors of the injection system of the internal combustion engine, multiple different corrective functions are used to establish corrected individual characteristics relative to nominal characteristics. Each offset of the corrected individual characteristic from the nominal characteristics is determined, offset curves are created, and the sections of the individual offset curves representing a minimal offset are used as control data for the amount of fuel to be injected, thus making it possible to always achieve overall optimal control with a minimal difference in the amount of injected fuel.

12 Claims, 2 Drawing Sheets

(56) References Cited

U.S. PATENT DOCUMENTS

| | | | | |
|---|---|---|---|---|
| 7,363,141 | B2 | 4/2008 | Fujii | 701/104 |
| 8,554,454 | B2 * | 10/2013 | Hemmerlein | F02M 63/0225 123/479 |
| 2003/0164166 | A1 * | 9/2003 | Takeuchi | F02D 41/0085 123/674 |
| 2003/0233997 | A1 * | 12/2003 | Kawaguchi | F02D 41/0085 123/299 |
| 2004/0128054 | A1 * | 7/2004 | Jaliwala | F02D 41/2467 701/104 |
| 2004/0128055 | A1 * | 7/2004 | Jaliwala | F02D 41/2441 701/104 |
| 2006/0047405 | A1 * | 3/2006 | Bouchain | F02D 41/123 701/104 |
| 2006/0090733 | A1 * | 5/2006 | Fujii | F02D 41/2438 123/446 |
| 2009/0299608 | A1 * | 12/2009 | Loeffler | F02D 35/023 701/104 |
| 2010/0116911 | A1 * | 5/2010 | Fritsch | F02D 41/2096 239/580 |
| 2011/0077843 | A1 | 3/2011 | Hauser | 701/105 |
| 2013/0152902 | A1 * | 6/2013 | Brandt | F02D 41/2432 123/480 |

FOREIGN PATENT DOCUMENTS

| | | | | |
|---|---|---|---|---|
| DE | 10232356 | A1 | 1/2004 | |
| DE | 10257686 | A1 | 7/2004 | F02D 41/12 |
| DE | 102004050761 | A1 | 4/2006 | F02D 41/30 |
| DE | 102008024546 | B3 | 1/2010 | F02D 41/00 |
| DE | 102009009270 | A1 | 8/2010 | F02D 41/20 |
| WO | 2012/143189 | A2 | 10/2012 | F02D 41/24 |

OTHER PUBLICATIONS

Chinese Office Action, Application No. 201280019390.6, 12 pages (Aug. 5, 2015).

* cited by examiner

METHOD FOR THE OPERATION OF AN INTERNAL COMBUSTION ENGINE, AND INTERNAL COMBUSTION ENGINE

CROSS-REFERENCE TO RELATED APPLICATIONS

This application is a U.S. National Stage Application of International Application No. PCT/EP2012/054765 filed Mar. 19, 2012, which designates the United States of America, and claims priority to DE Application No. 10 2011 007 642.5 filed Apr. 19, 2011, the contents of which are hereby incorporated by reference in their entirety.

TECHNICAL FIELD

The present invention relates to a method for operating an internal combustion engine provided with an injection system having at least one injector, and with a control unit for same. The invention is also directed to an internal combustion engine which has an injection system having at least one injector, and a control unit for same.

BACKGROUND

Some internal combustion engines have what are referred to as common-rail injection systems in which a plurality of injection valves are supplied with a common fuel line which is subjected to a largely uniformly high pressure. The injection quantities to be respectively injected into each cylinder of an internal combustion engine at the start of a working stroke are typically metered primarily here by the injection valves or injectors being actuated with a selected shorter or longer actuation duration during which these injection valves are opened and fuel is injected into the respective cylinder. In this context, the need to adapt actually injected injection quantities to corresponding setpoint injection quantities arises. Basically, injectors exhibit an individual quantity behavior corresponding to the fabrication tolerances. In addition, this property changes over the service life of the injector due to wear and environmental influences. In particular, wear phenomena or deposits can therefore lead to a situation in which an actual opening period or an actual degree of opening of the injection valves at a given fuel pressure and with a given actuation period changes during the service life of the injection valves. However, in order to ensure the performance and exhaust gas emissions, the variation and the service life drift which occurs must not exceed a certain amount.

When injection valves are used there are nowadays various measures for ensuring the desired accuracy. Basically, a predefined setpoint value in the form of a characteristic diagram is stored in the control unit of the injection system. Here, the injection quantity which proves to be "normal" in the new state is mapped. In addition, this characteristic diagram is adapted to the individual tolerances of the respective instance by suitable injector coding. Furthermore, different algorithms and/or correction functions which detect the quantity drift and correct it are stored in the control unit software. In this context, permissible ranges in the injector characteristic diagram are defined for the respective functions in terms of calibration. In the transition region, the correction variables are changed one into the other by interpolation. The definition of the regions is based on considerations of the possibility and effectiveness of correction of the respective adaptation function.

In order to compensate a corresponding drift of properties of an injection valve in the course of its service life, it is known, for example from published document DE 102 57 686 A1, to carry out what are referred to as minimum quantity adaptations in which the influence of injected minimum quantities of fuel on segment times of a crankshaft movement of the internal combustion engine is analyzed. Further adaptation methods for minimum quantities and for medium to relatively large quantities are also known.

However, such known adaptation methods are only ever used once. However, this has the disadvantage that methods which are configured for certain conditions, for example methods which are determined for minimum quantities, fail under other conditions, for example in the case of medium to relatively large quantities, or produce inaccurate results. The adaptation quality is therefore not particularly high.

SUMMARY

One embodiment provides a method for operating an internal combustion engine provided with an injection system having at least one injector, and with a control unit for same, comprising the following steps: storage of the predefined setpoint value of the injection quantity of the injector in the form of a nominal characteristic diagram having nominal characteristic curves in the control unit; adaptation of this nominal characteristic diagram to the individual tolerances of the injector using suitable injector coding in order to obtain an individual characteristic diagram having individual characteristic curves; applying a plurality of different correction functions for detecting and correcting the service life quantity drift of the injector in order to obtain a plurality of corrected individual characteristic diagrams having corrected individual characteristic curves; and determining the respective offset of the corrected individual characteristic curves with respect to the nominal characteristic curves in order to produce offset curves and using the sections of the individual offset curves which constitute a minimum offset as actuation correction data for the injection quantity, wherein in each case the minimum offset of the next offset curve is used if two offset curves intersect.

In a further embodiment, a single new corrected individual characteristic diagram is produced from the plurality of corrected individual characteristic diagrams and is stored instead of the previous individual characteristic diagram.

In a further embodiment, a minimum quantity correction function, e.g., an MFMA function, is applied as a correction function.

In a further embodiment, a correction function for medium to relatively large quantities, e.g., an FMO function, is applied as a correction function.

Another embodiment provides an internal combustion engine having an injection system having at least one injector, and a control unit for same, wherein the control unit is designed to carry out the method according to one of the preceding claims.

BRIEF DESCRIPTION OF THE DRAWINGS

Example embodiments are explained in detail below with reference to the drawings, in which.

DETAILED DESCRIPTION

Figure 1:
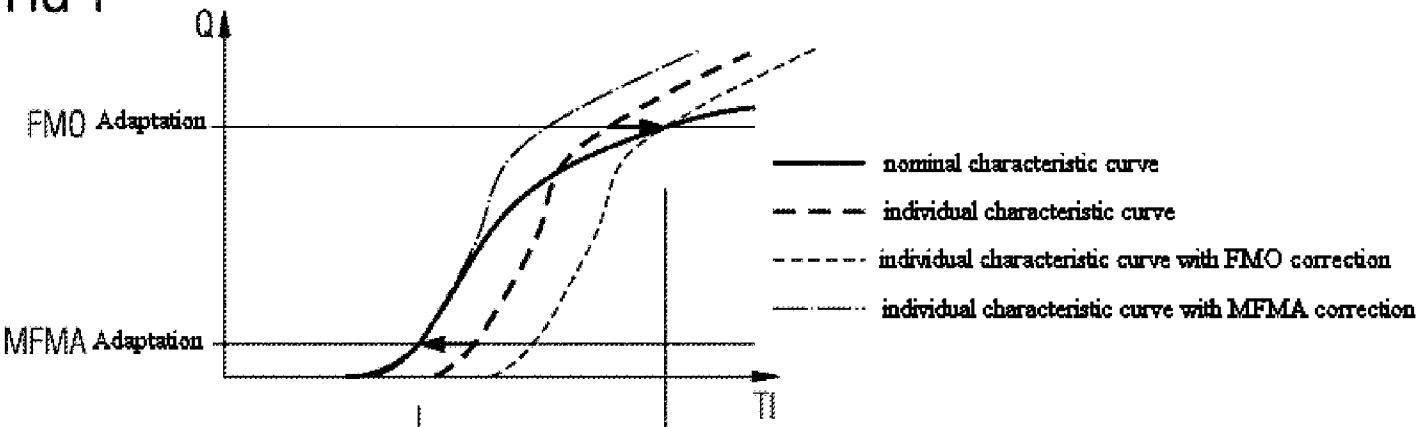
FIG. 1 shows a diagram which shows the injection quantity (Q) as a function of the time (Ti) and in which the various characteristic curves are illustrated.

Embodiments of the present disclosure provide a method for achieving accurate injection over the service life of the injectors.

Some embodiments provide a method for operating an internal combustion engine provided with an injection system having at least one injector, and with a control unit for same, which method comprises the following steps:

storage of the predefined setpoint value of the injection quantity of the injector in the form of a nominal characteristic diagram having nominal characteristic curves in the control unit;

adaptation of this nominal characteristic diagram to the individual tolerances of the injector using suitable injector coding in order to obtain an individual characteristic diagram having individual characteristic curves;

applying a plurality of different correction functions for detecting and correcting the service life quantity drift of the injector in order to obtain a plurality of corrected individual characteristic diagrams having corrected individual characteristic curves; and determining the respective offset of the corrected individual characteristic curves with respect to the nominal characteristic curves in order to produce offset curves and using the sections of the individual offset curves which constitute a minimum offset as actuation correction data for the injection quantity, wherein in each case the minimum offset of the next offset curve is used if two offset curves intersect.

In one embodiment, the predefined setpoint value of the injection quantity of the corresponding injector is stored in a known fashion in the form of a nominal characteristic diagram in the control unit. This nominal characteristic diagram is adapted to the individual tolerances of the injector which are present using the injector coding which is present, and an individual characteristic diagram is produced for the injector. Through the injector coding which is present and the individual adaptation of the respective injector characteristic diagram which is produced as a result, the tolerance position of each injector in the system is known. This individual characteristic diagram is stored, along with the nominal characteristic diagram, in the control unit, i.e. is saved in the associated memory.

Various adaptation methods are then carried out in order to detect and correct the service life quantity drift of the injector. Basically, it is possible to apply any desired number of correction algorithms. The mapping of the correction brings about a deviation of zero with respect to the nominal characteristic diagram at the correction point itself. The greater the distance between the points and the adaptation point, the greater in turn is the quantity deviation which occurs. If this quantity deviation of all the adaptations is illustrated plotted against the setpoint actuation (predefined setpoint value of the injection quantity), the respective minimum of all the correction curves is the minimum deviation of the corrected quantity for the respective actuation.

According to one embodiment, the respective offset of the corrected individual characteristic curves from the nominal characteristic curves is now determined in order to produce corresponding offset curves. In the process, the sections of the individual offset curves which constitute a minimum offset are used as actuation correction data for the injection quantity, wherein in each case the minimum offset of the next offset curve is used if two offset curves intersect.

In contrast to the prior art, minimum offset of a plurality of correction functions may be used to supply the corresponding correction data. In this context, a first correction curve is used as the basis until this first correction curve is intersected by a second correction curve. Starting from this point of intersection, the second correction curve is used up to the point of intersection of a third correction curve, etc. This results overall in optimum actuation with a minimum quantity deviation.

In one embodiment, the individual characteristic curve of the injector is taken into account. Corrections are adapted in an optimum way to the respective form (tolerance position) of the injector. Overall, a significantly improved adaptation quality is achieved. The number of adaptation functions used is virtually unlimited. An undesired interaction between the adaptation strategies is ruled out.

Preferably, a single new corrected individual characteristic diagram is produced from the plurality of corrected individual characteristic diagrams and is stored instead of the previous individual characteristic diagram. The method can therefore be applied in a new system (of a new internal combustion engine), and the previous individual characteristic diagram can be replaced by the new corrected individual characteristic diagram. As a result, the quantity drift occurring within the service life of the injection system can be continuously tracked in the same way with the result that overall optimum actuation with minimum quantity deviation always occurs.

In one embodiment, a minimum quantity correction function, e.g., an MFMA (Minimum Fuel Mass Adaption) function can be applied, for example, as a correction function. In addition, a correction function for medium to relatively large quantities, in particular an FMO (Fuel Mass Observer) function, can be carried out as a correction function. As mentioned, overall any desired number of such adaptation functions is possible. If only the two functions mentioned above are applied, two offset curves (dQ curves) result, wherein the offset curve of the minimum quantity correction function (MFMA function) in the dQ–Ti diagram passes through a minimum, then rises and intersects the offset curve of the correction function for medium to relatively large quantities (FMO function). Starting from this point of intersection, the offset curve (dQ curve) of the correction function for medium to relatively large quantities is followed, said offset curve then passing through its minimum.

Other embodiments provide an internal combustion engine having an injection system having at least one injector, and a control unit for same, wherein the control unit is programmed to carry out the method described above. The control unit therefore has a memory for storing the predefined setpoint value of the injection quantity of the injector. Furthermore, the control unit is capable of storing an individual characteristic diagram in the memory using the injector coding which is present, said characteristic diagram corresponding to adaptation of the stored nominal characteristic diagram to the individual tolerances of the injector. Furthermore, the respective algorithms for the corresponding correction functions with respect to the service life quantity drift are stored in the control unit.

The control unit produces the respective offset curves and uses the sections of the individual offset curves which constitute a minimum offset as actuation correction data for the injection quantity corresponding to the disclosed method, wherein the duration of the respective injection periods given a constant pressure is preferably defined or corrected.

Figure 2:
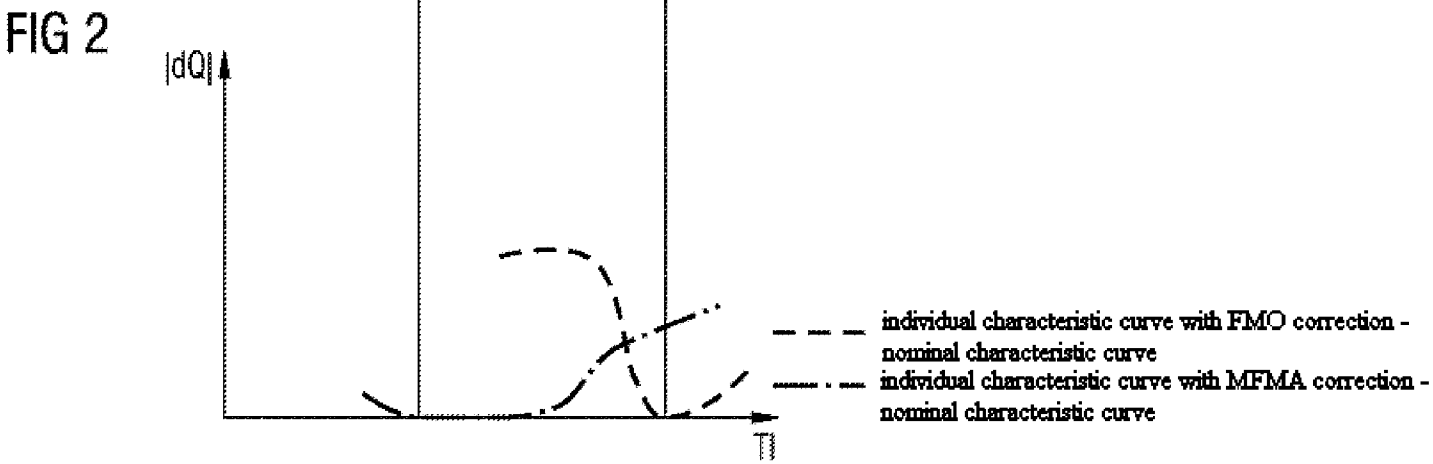
FIG. 2 shows a diagram showing the quantity deviation |dQ| as a function of the time (Ti), wherein two offset curves are illustrated.
Figure 3:
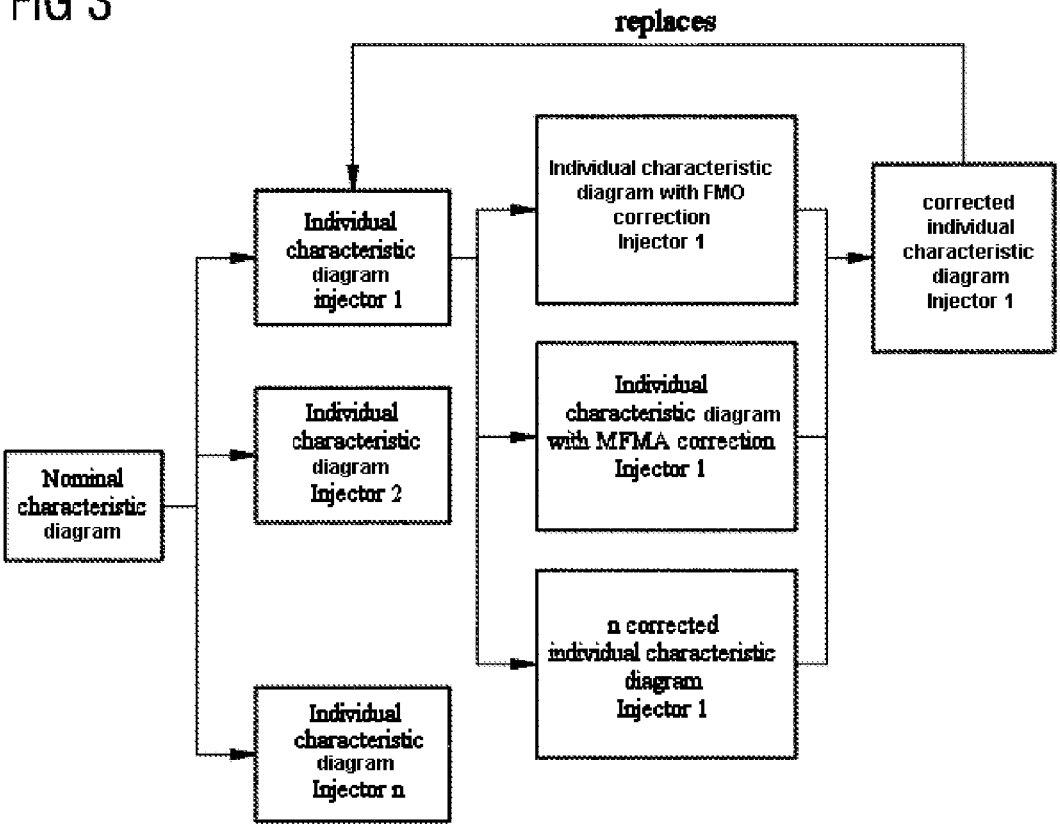
FIG. 3 shows a schematic illustration of the individual steps in the method according to one embodiment.

The internal combustion engine to which FIGS. 1 to 3 relate may be, for example, a diesel engine which is operated as a four stroke engine and has four cylinders and a common rail injection system as the injection device. The injection system is assigned a control unit with which the duration of the individual injection periods is controlled. This control unit is embodied and/or programmed to perform the inventive method disclosed herein.

The predefined setpoint value of the injection quantity of the injectors is stored in the control unit in the form of a nominal characteristic diagram having nominal characteristic curves. A nominal characteristic curve with a continuous curve is illustrated in FIG. 1. In order to take into account the variation of the respective injector in the adaptation method, this nominal characteristic diagram is adapted to the individual tolerances of the injector using suitable injector coding which is present, wherein an individual characteristic diagram having individual characteristic curves is obtained. Such an individual characteristic curve is illustrated in FIG. 1 with the thick dashed line. The tolerance position of each injector in the system is known from the injector coding.

Both characteristic diagrams (nominal characteristic diagram and individual characteristic diagram) are saved in the memory of the control unit.

In order to take into account the service life drift which occurs, a plurality of adaptation methods are now carried out and the correction which is found is respectively applied to the entire characteristic diagram. In the present example, two corrections are carried out, specifically a minimum quantity correction (MFMA) and a correction for medium to relatively large quantities (FMO). The corrected individual characteristic curves which are obtained are illustrated in FIG. 1, specifically in the form of dashed lines as individual characteristic curve with FMO correction and as dot-dashed lines as individual characteristic curve with MFMA correction. At the correction point itself, the deviation from the nominal characteristic curve is zero. The greater the distance between the points of the corrected individual characteristic curve and the adaptation point, the greater in turn is the quantity deviation which occurs.

FIG. 2 illustrates the quantity deviation of these two adapted individual characteristic curves with respect to the nominal characteristic curve as the determined offset of the respective correction function in the diagram |dQ|−Ti. The dashed curve corresponds to the offset of the individual characteristic curve with FMO correction, while the dot-dashed curve corresponds to the offset of the individual characteristic curve with MFMA correction.

Of the two offset curves (dQ curves) illustrated in FIG. 2, the sections constituting a minimum offset are used as actuation correction data for the injection quantity. Here, in each case the minimum offset of the next offset curve is used if two offset curves intersect. According to FIG. 2 this means that the section of the dot-dashed offset curve up to the point of intersection with the dashed offset curve, and starting from this point of intersection the corresponding section of the dashed offset curve, are used for correction. The respective minimum of all the correction curves is therefore used for the correction.

FIG. 3 shows a schematic illustration of the sequence of the method according to one embodiment. The predefined setpoint value of the injection quantity is stored as a nominal characteristic diagram in the control unit. This nominal characteristic diagram is adapted to the individual tolerances of each injector using suitable injector coding. Individual characteristic diagrams are obtained for each injector. These individual characteristic diagrams are corrected by means of corresponding adaptation functions in order to take into account the service life drift which occurs. This is illustrated in FIG. 3 for the injector 1, specifically for an FMO correction and an MFMA correction. Correspondingly corrected individual characteristic diagrams are obtained. A new corrected individual characteristic diagram is determined from the determined minimum offset data and replaces the previously used individual characteristic diagram. As a result, the quantity drift occurring with the service life can be continuously tracked in the same way, with the result that overall optimum actuation with minimum quantity deviation always occurs.

What is claimed is:

1. A method for operating an internal combustion engine including an injection system having at least one injector and an injector system control unit, the method comprising, for a particular injector:

storing a predefined setpoint value of an injection quantity of the injector in the form of a nominal characteristic diagram having nominal characteristic curves in the control unit;

adapting the nominal characteristic diagram to individual tolerances of the injector using injector coding to obtain an individual characteristic diagram having individual characteristic curves;

applying a plurality of different correction functions for detecting and correcting a service life quantity drift of the injector to obtain a plurality of corrected individual characteristic diagrams having corrected individual characteristic curves;

determining offsets of the corrected individual characteristic curves with respect to the nominal characteristic curves to produce offset curves, and using sections of the offset curves that define a minimum offset as actuation correction data for the injection quantity, wherein in each case the minimum offset of the next offset curve is used if two offset curves intersect.

2. The method of claim 1, comprising generating a single new corrected individual characteristic diagram from the plurality of corrected individual characteristic diagrams and storing the single new corrected individual characteristic diagram instead of the previous individual characteristic diagram.

3. The method Of claim 1, comprising applying a minimum quantity correction function as a correction function.

4. The method of claim 1, comprising applying a correction function for medium to relatively large quantities as a correction function.

5. The method of claim 3, wherein the correction function is a minimum fuel mass adaption (MFMA) function.

6. The method of claim 4, wherein the correction function is a fuel mass observer (FMO) function.

7. An internal combustion engine having an injection system comprising:

at least one injector, and a control unit configured to, for a particular injector:

store a predefined setpoint value of an injection quantity of the injector in the form of a nominal characteristic diagram having nominal characteristic curves in the control unit;

adapt the nominal characteristic diagram to individual tolerances of the injector using injector coding to obtain an individual characteristic diagram having individual characteristic curves;

apply a plurality of different correction functions for detecting and correcting a service life quantity drift of the injector to obtain a plurality of corrected individual characteristic diagrams having corrected individual characteristic curves;

determine offsets of the corrected individual characteristic curves with respect to the nominal characteristic curves to produce offset curves, and use sections of the offset curves that define a minimum offset as actuation correction data for the injection quantity, wherein in each case the minimum offset of the next offset curve is used if two offset curves intersect.

8. The internal combustion engine of claim 7, wherein the control unit is configured to generate a single new corrected individual characteristic diagram from the plurality of corrected individual characteristic diagrams, and store the single new corrected individual characteristic diagram instead of the previous individual characteristic diagram.

9. The internal combustion engine of claim 7, wherein the control unit is configured to apply a minimum quantity correction function as a correction function.

10. The internal combustion engine of claim 9, wherein the correction function is a minimum fuel mass adaption (MFMA) function.

11. The internal combustion engine of claim 7, wherein the control unit is configured to apply a correction function for medium to relatively large quantities as a correction function.

12. The internal combustion engine of claim 11, wherein the correction function is a fuel mass observer (FM0) function.

* * * * *